US008733454B2

(12) United States Patent
Bouligny et al.

(10) Patent No.: US 8,733,454 B2
(45) Date of Patent: May 27, 2014

(54) ELEVATOR GRIP ASSURANCE

(75) Inventors: Vernon Bouligny, New Iberia, LA (US); Phillip M. Theriot, Lafayette, LA (US); Reese Comeaux, Carencro, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 381 days.

(21) Appl. No.: 13/036,610

(22) Filed: Feb. 28, 2011

(65) Prior Publication Data

US 2012/0055682 A1 Mar. 8, 2012

Related U.S. Application Data

(60) Provisional application No. 61/309,202, filed on Mar. 1, 2010.

(51) Int. Cl.
*E21B 19/16* (2006.01)

(52) U.S. Cl.
USPC ..... 166/380; 166/77.52; 294/102.2; 294/907

(58) Field of Classification Search
USPC ..... 166/380, 77.51–77.53; 175/162, 203; 116/67 R, 68; 294/102.1, 102.2, 907; 414/22.51–22.71
See application file for complete search history.

(56) References Cited

U.S. PATENT DOCUMENTS 2,313,243 A * 3/1943 Johnson ..... 414/22.63
2,545,177 A * 3/1951 True ..... 188/67
2,722,450 A * 11/1955 Nelson ..... 294/90
2,829,617 A * 4/1958 Kelley ..... 116/67 R
4,269,554 A * 5/1981 Jackson ..... 414/22.63
4,361,940 A * 12/1982 McFadden ..... 188/67
4,489,794 A * 12/1984 Boyadjieff ..... 175/85
4,579,379 A * 4/1986 Berg ..... 294/102.2
4,625,796 A * 12/1986 Boyadjieff ..... 166/77.52
4,676,312 A 6/1987 Mosing et al.
5,272,925 A * 12/1993 Henneuse et al. ..... 73/862.541
5,340,182 A * 8/1994 Busink et al. ..... 294/199
5,791,410 A 8/1998 Castille et al.
5,909,768 A 6/1999 Castille et al.
6,386,282 B1 * 5/2002 Jansch ..... 166/53
6,626,238 B2 * 9/2003 Hooper ..... 166/66
6,742,596 B2 6/2004 Haugen
6,938,697 B2 9/2005 Haugen
6,968,895 B2 * 11/2005 Mosing et al. ..... 166/77.52
7,086,461 B2 * 8/2006 Schulze-Beckinghausen et al. ..... 166/77.53
7,182,133 B2 2/2007 Webre et al.
7,281,587 B2 10/2007 Haugen
7,370,707 B2 5/2008 McDaniel et al.

(Continued)

OTHER PUBLICATIONS

International Search Report and Written Opinion, PCT/US11/026476, Apr. 19, 2011, 7 pages.

*Primary Examiner* — Blake Michener
(74) *Attorney, Agent, or Firm* — Winstead PC

(57) ABSTRACT

According to one or more aspects of the invention an interlock device is adapted for connection within a load path of a tubular support device to lock the tubular support device in a closed position in response to detecting a load suspended from the tubular support device. The interlock device includes a first member moveably connected to a second member and a biasing mechanism operationally connected to the first member and the second member providing a load setting resisting movement of the first member and the second member relative to one another. The first and the second member may be rotationally locked with one another to transmit rotation across the interlock device to the elevator.

20 Claims, 9 Drawing Sheets

(56) References Cited

U.S. PATENT DOCUMENTS

| | | | | |
|---|---|---|---|---|
| 7,434,614 | B2 * | 10/2008 | Nelson et al. | 166/77.52 |
| 8,136,603 | B2 * | 3/2012 | Schneider | 166/380 |
| 8,356,675 | B2 * | 1/2013 | Pietras et al. | 166/380 |
| 2004/0069500 | A1 * | 4/2004 | Haugen | 166/380 |
| 2004/0188098 | A1 * | 9/2004 | Schulze-Beckinghausen et al. | 166/380 |
| 2005/0051324 | A1 * | 3/2005 | Mosing et al. | 166/66 |
| 2006/0011352 | A1 * | 1/2006 | Nelson et al. | 166/379 |
| 2006/0169461 | A1 * | 8/2006 | Haugen | 166/380 |
| 2008/0060818 | A1 | 3/2008 | Bourgeois et al. | |
| 2008/0264648 | A1 | 10/2008 | Pietras et al. | |
| 2009/0272542 | A1 | 11/2009 | Begnaud et al. | |
| 2009/0314496 | A1 | 12/2009 | Begnaud et al. | |
| 2011/0017474 | A1 | 1/2011 | Pietras et al. | |

* cited by examiner

ELEVATOR GRIP ASSURANCE

RELATED APPLICATIONS

This application is a non-provisional application claiming priority to provisional application No. 61/309,202, filed on Mar. 1, 2010, which is hereby incorporated by reference in its entirety.

BACKGROUND

This section provides background information to facilitate a better understanding of the various aspects of the present invention. It should be understood that the statements in this section of this document are to be read in this light, and not as admissions of prior art.

Tubular strings are inserted into and pulled from wellbores (e.g., boreholes) at various times during the life of a well for various purposes. For example, tubular strings (e.g., drill pipe) are assembled and run into the well for drilling the wellbore, to line the wellbore (e.g., casing, liners, screens, etc.), and to position tools (e.g., tubing, etc.) in the wellbore.

A rig is typically employed to assemble the tubular string for insertion into the wellbore and to dissemble the tubular string as it is pulled from the wellbore. Generally, a rig floor mounted support device, e.g., a gripping spider, supports a first tubular (e.g., casing) that extends into the wellbore. A single joint elevator may be utilized to hoist the add-on tubular segment and align it with the first tubular. The add-on tubular segment is then connected (e.g., made-up) to the first tubular to form a tubular string. Threaded tubulars may be made-up by various tools including, but not limited to, power tongs, spinners, and top drives. A vertically movable support device, e.g., string elevator, top drive quill, or tubular running tool, engages the add-on tubular to support the tubular string. The floor mounted support device, e.g., spider, then disengages the tubular string and the tubular string is lowered therethrough to a desired position. The floor mounted support device, e.g., spider, then re-engages the tubular string and the vertically movable support device, e.g., string elevator, disengages the tubular string. The sequence may be reversed when pulling the tubular string from the wellbore and disassembling the tubular string.

Various safety systems have been utilized to ensure or promote assurance that at least one of the floor mounted tubular support device and a vertically moveable tubular support device (e.g., elevator) is in engagement with a tubular segment before the other tubular support device is permitted to release its load supporting engagement of the tubular. For example, interlock systems such as the grip assurance systems disclosed in U.S. Pat. Nos. 4,676,312, 5,791,410 and 5,909,763, which are incorporated herein by reference, have been provided to ensure that at least one tubular support device is engaged with the tubular string before the other tubular support device is disengaged from the tubular. However, heretofore an interlock system has not been provided that prevents opening a tubular support device in response to sensing a load acting on the tubular support device.

SUMMARY

According to one or more aspects of the invention, an interlock device adapted for connection within a load path of a tubular support device includes a first member moveably connected to a second member; a biasing mechanism operationally connected to the first member and the second member providing a load setting resisting movement of the first member and the second member relative to one another; and a sensor adapted to detect movement of the first member and the second member relative to one another, wherein the sensor is operationally connectable to the tubular support device to lock the tubular support device in a closed position in response to detecting the movement of the first member and the second member relative to one another. The first and the second member may be rotationally locked with one another.

An embodiment of an elevator grip assurance system according to one or more aspects of the invention includes an interlock device connected in the load path of an elevator, the interlock device comprising a load setting urging a first member and a second member into an unloaded position relative to one another; and a sensor to lock the elevator in a closed position in response to a weight suspended from the elevator.

A method, according to one or more aspects of the invention, includes suspending a tubular from an elevator, wherein the elevator is in a closed position supporting the tubular; detecting a load suspended from the elevator; and locking the elevator in the closed position in response to the detected load.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
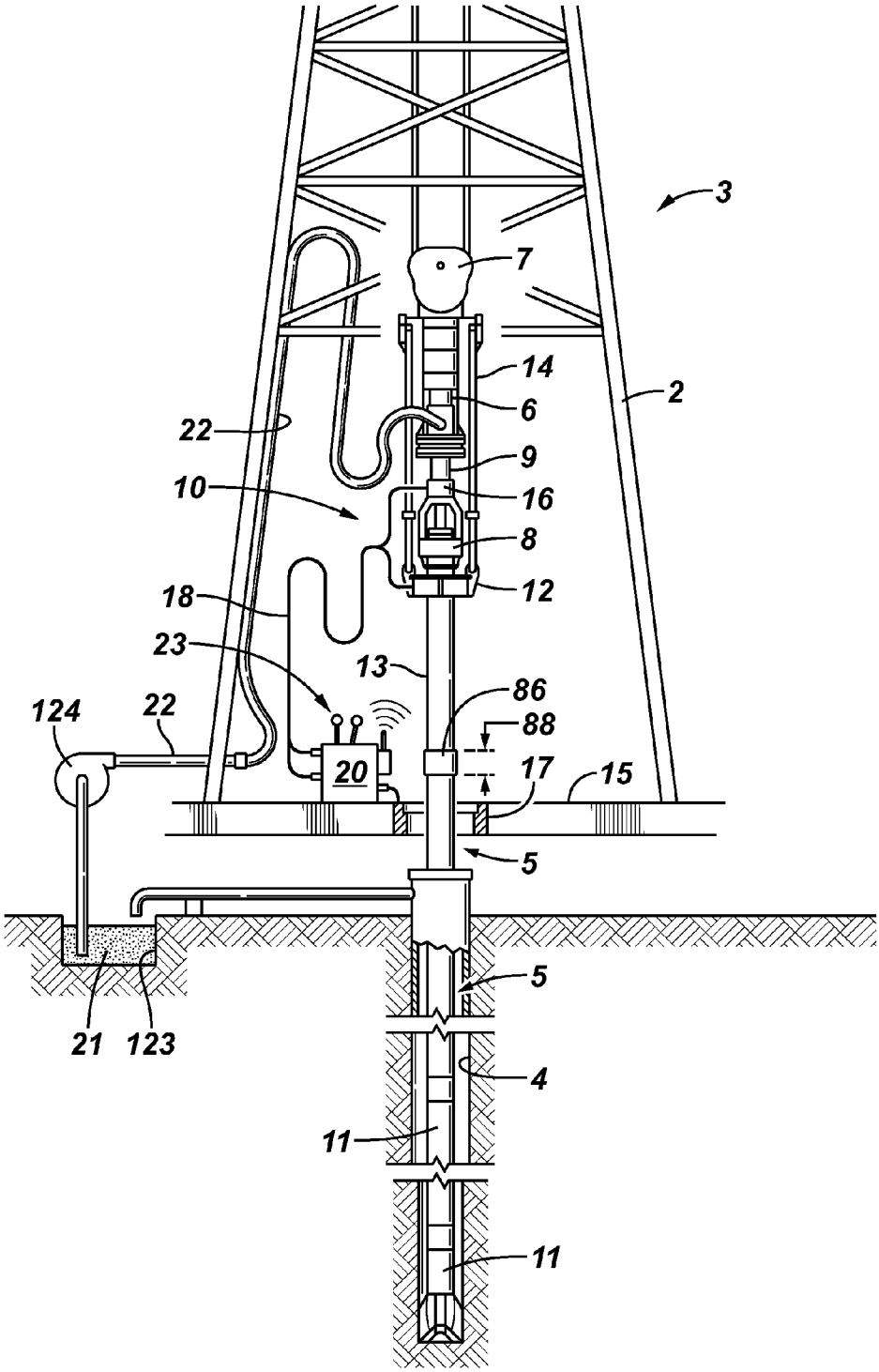
FIG. 1 is a schematic view of an example of a wellbore tubular running system incorporating an elevator grip assurance system according to one or more aspects of the disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the well being the lowest point, wherein the well (e.g., wellbore, borehole) is vertical, horizontal or slanted relative to the surface. The terms "pipe," "tubular," "tubular member," "casing," "liner," tubing," "drill pipe," "drill string" and other like terms can be used interchangeably. The terms may be used in combination with "joint" to mean a single unitary length; a "stand" to mean one or more, and typically two or three, interconnected joints; or a "string" meaning two or more interconnected joints.

In this disclosure, "fluidicly coupled" or "fluidicly connected" and similar terms, may be used to describe bodies that are connected in such a way that fluid pressure may be transmitted between and/or among the connected items. The term "in fluid communication" is used to describe bodies that are connected in such a way that fluid can flow between and/or among the connected items. It is noted that fluidicly coupled may include certain arrangements where fluid may not flow between the items, but the fluid pressure may nonetheless be transmitted. Thus, fluid communication is a subset of fluidicly coupled. As will be understood with the description below, fluidic, fluidicly and similar terms may comprise electrical power and electrically powered devices.

FIG. 1 is a schematic view of an example of a wellbore tubular running system 3 incorporating an elevator grip assurance system, generally denoted by the numeral 10, according to one or more aspects of the invention. FIG. 1 depicts a structure 2 (e.g., rig, drilling rig, etc.) positioned over a wellbore 4 in which a tubular string 5 is deployed. Depicted system 3 includes a top drive 6 suspended from a hoisting device 7, depicted as a traveling block, for vertical movement relative to wellbore 4. In FIG. 1, an elevator 8 (e.g., string elevator, tubular running device or tool) is connected to top drive 6 via quill 9 (e.g., spindle, drive shaft) which includes a bore for disposing fluid (e.g., drilling fluid, mud) into tubular string 5.

Tubular string 5 comprises a plurality of interconnected tubular segments each generally denoted by the numeral 11. The upper most or top tubular segment is referred to as an add-on tubular 13. The lower end (e.g., pin end, distal end relative to traveling block 7) of add-on tubular 13 is depicted disposed with the top end (e.g., box end) of the top tubular segment of tubular string 5 which extends above rig floor 15. Tubular string 5 is disposed through a support device 17 (e.g., spider slip assembly, spider, collar load support assembly) disposed at floor 15. Spider 17 is operable to a closed position to grip and suspend tubular string 5 in wellbore 4 for example while add-on tubular 13 is being connected to or disconnected from tubular string 5.

An elevator 12 (e.g., single joint elevator) is depicted in FIG. 1 suspended from bails 14 which may be suspended, for example, from traveling block 7 and/or top drive 6, for example, the bails, or link arms, may be actuated to a non-vertical position to pick up add-on tubular 13 from a V-door of the rig. The particular elevator 12 depicted in FIG. 1 is provided to illustrate one example of an elevator for transporting add-on tubular 13 to and from general alignment (e.g., staging area) with wellbore 4, for example, to threadedly connect add-on tubular 13 to tubular string 5.

As used herein, "elevator," "elevator slips" and "elevator devices" generally mean an apparatus or mechanism that is arranged to support a tubular for the purpose of raising or lowering the tubular. The elevator may grip the tubular radially (e.g., slip type) and/or suspend the tubular on a shoulder. Examples of elevator devices include external slip devices, such as illustrated in FIG. 1, as well as internal tubular gripping devices that are often used with top drive systems. The elevator may be adapted to apply torque or rotation to the supported tubular, for example to connect or disconnect tubular joints and for the purpose of drilling. "Spider" or "spider slips" refer to a device for gripping and supporting the tubular string, while the device remains substantially stationary. Often the spider is supported by the rig floor or deck.

Elevators 8, 12, and spider 17 are depicted as being powered and/or controlled between their open and closed positions via pressurized fluid (e.g., gas, liquid) and/or electricity, via control (e.g., power) line 18 (e.g., umbilical, conduit). For purposes of description, "open" is used herein to mean that the tubular support device is actuated to a position disengaged from and not supporting the tubular. "Closed" is used herein to mean that the tubular support device is operated so as to support the weight of the suspended tubular. These terms apply to both external and internal tubular gripping or supporting devices. The tubular support devices are typically manually operated between the open and closed positions from a common location, generally referred to herein as a controller 20 or control console.

According to one or more aspects of the invention, elevator grip assurance system 10 assures that the vertically moveable tubular support device (e.g., elevator 12, tubular running device 8) is in effect locked in the closed position when it is supporting a tubular (e.g., add-on tubular 13), thereby preventing accidental operation of the elevator to the open position and dropping the tubular. According to one or more aspects of the invention, elevator grip assurance system 10 blocks operational communication to the closed elevator in response to a load suspended from the elevator device. For example, elevator grip assurance system 10 includes an interlock device 16 that is connected within the load path of the grip assured elevator 8 in FIG. 1. In this example, interlock device 16 is positioned between traveling block 7 and elevator 8 to detect a load suspended from elevator 8. According to one or more aspects of the invention, interlock device 16 blocks operational communication to elevator 8 in response to detecting a load associated with the weight of add-on tubular 13 suspended from elevator 8, thereby preventing operation of elevator 8 to the open position. Operational communication (e.g., control) of the grip assured elevator may be blocked in various manners, including electronic blocking for example at controller 20; physical blocking of movement of control elements 23 (e.g., levers, buttons, etc.) at controller 20 (see for example, U.S. 2009/0272542 which is incorporated herein by reference); and/or blocking of communication through control line 18. As will be understood by those skilled in the art with reference to this disclosure, interlock device 16 may be physically positioned (e.g., connected, attached) at various locations within a tubular running system as demonstrated by example of the embodiments depicted and described in this disclosure.

FIG. 1 depicts fluid 21 (e.g., drilling fluid, mud, cement, liquid, gas) provided to tubular string 5 via mud line 22. Mud line 22 is generically depicted extending from a reservoir 123 (e.g., tank, pit) of fluid 21 via pump 124 and into tubular string 5 via elevator 8 (e.g., fluidic connector, fill-up device, etc.). Fluid 21 may be introduced to device 8 and add-on tubular 13 and tubular string 5 in various manners including through a bore extending from top drive 6 and the devices intervening the connection of the top drive to add-on tubular 13. For example, rotary swivel unions may be utilized to provide fluid connections for fluidic power and/or control lines 18 and/or mud line 22. Swivel unions may be adapted so that the inner member rotates for example through a connection to the rotating quill. Swivel unions may be obtained from various sources including Dynamic Sealing Technologies located at Andover, Minn., USA. Swivel unions may be used in one or more locations to provide relative movement between and/or across a device in addition to providing a mechanism for attaching and or routing fluidic line and/or electric lines.

Figure 2:
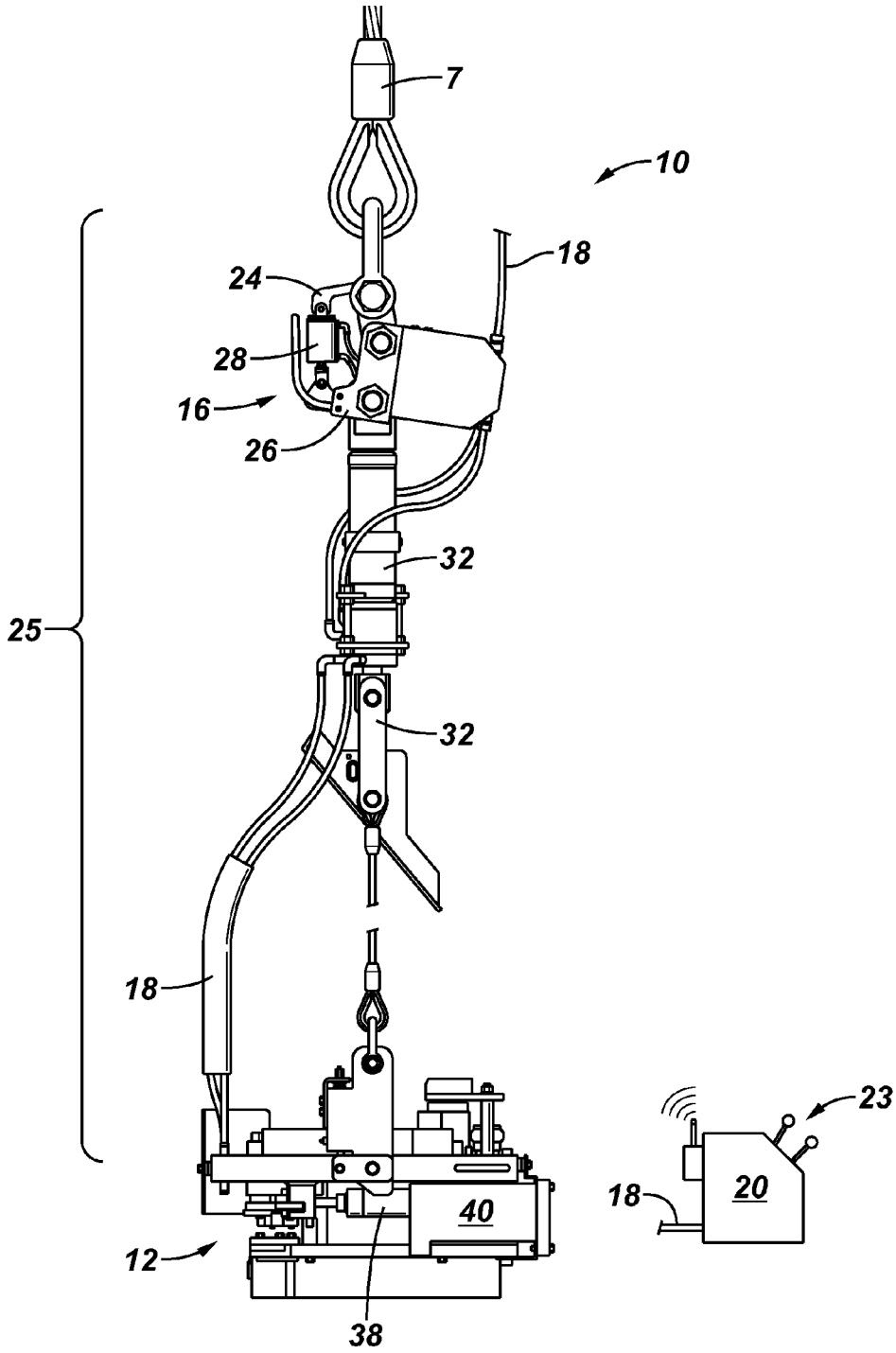
FIG. 2 is an elevation view of an embodiment of the grip assurance system illustrating an interlock device according to one or more aspects of the invention in an unloaded position.
Figure 2A:
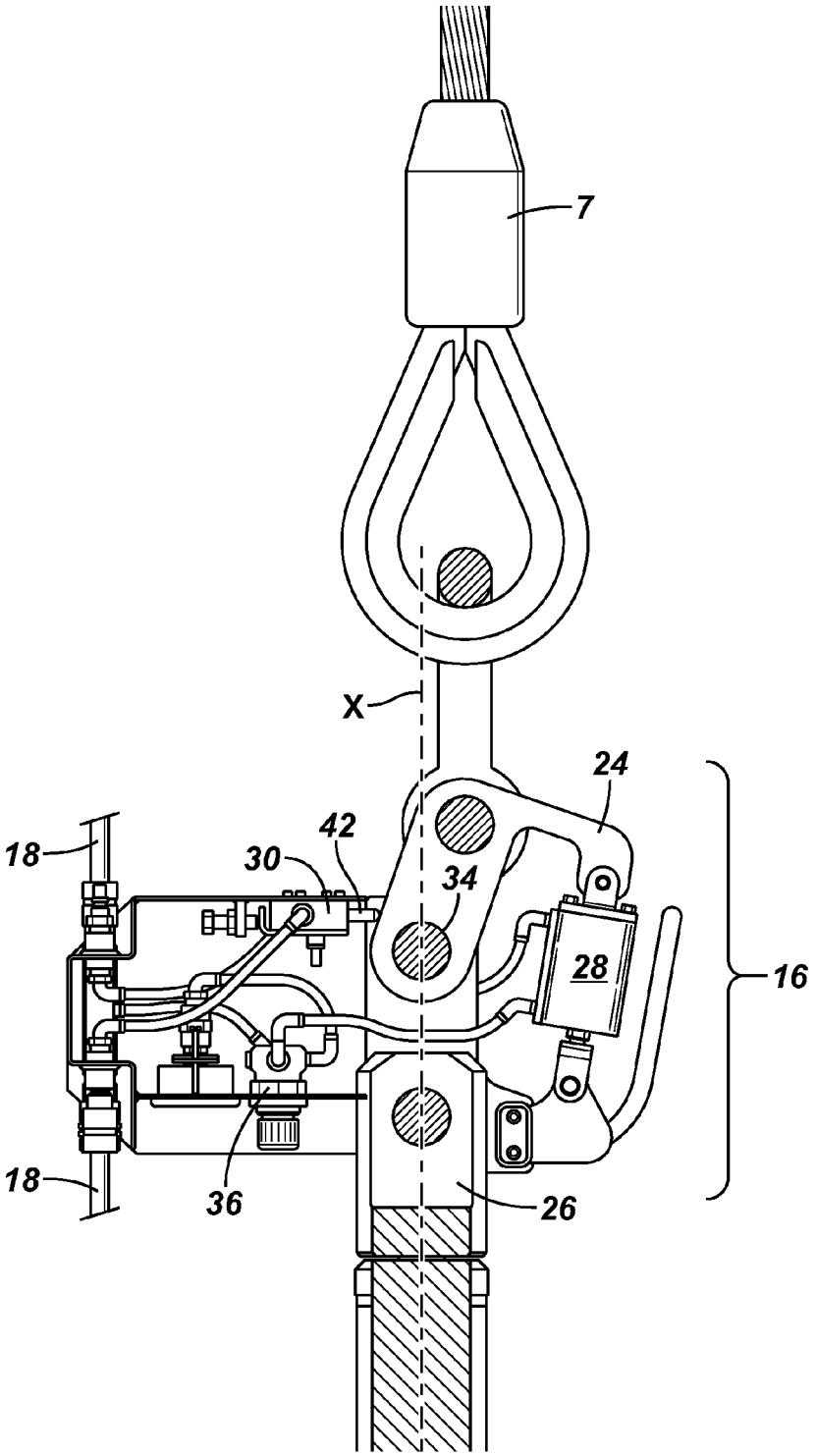
FIGS. 2A, 3A are expanded sectional views of the interlock devices depicted in FIGS. 2 and 3 respectively.

FIG. 2 is an elevation view of an embodiment of elevator grip assurance system 10 depicting an interlock device 16 in an unloaded position. FIG. 2A is an expanded, sectional view of interlock device 16 of FIG. 2 in the unloaded position. Elevator 12 is depicted in FIGS. 2, 2A as a single joint elevator ("SJE") suspended from a hoisting device 7, which is generally depicted to represent one or more devices from which elevator 12 may be suspended (e.g., drawworks, winch, sheave, traveling block, top drive, etc.).

With reference in particular to FIGS. 2 and 2A, the depicted interlock device 16 includes a first member 24 moveably connected with a second member 26, a biasing device 28, and a sensor 30. First and second members 24, 26 are adapted to connect within the load path of an elevator in a tubular running system (e.g., FIG. 1). For example, in FIG. 2, first member 24 is depicted attached to hoisting device 7 and elevator 12 is depicted attached to, and suspended from, second member 26 by members generally referred to as tethers 32. Tethers 32 may include one or more elements (e.g., wire rope, lift line, slings, bails, links, cables, etc.) sufficient to suspend and support elevator 12 and add-on tubular 13. For the purpose of describing various aspects of the invention, the load path, generally denoted by the numeral 25, extends from elevator 12 to hoisting device 7 and includes hoisting device 7, tether 32, and interlock device 16 in the depicted example.

In the embodiment depicted in FIGS. 2, 2A, first member 24 and second member 26 are moveably connected to one another at a pivot point represented by pin 34. According to one or more aspects of the invention, first and second members 24, 26 are also interconnected by a biasing device 28 which biases interlock device 16 to the depicted unloaded position thereby compensating for the weight of the elements in load path below interlock device 16. Biasing device 28 is depicted in this embodiment as a fluidic (e.g., pneumatic, hydraulic) cylinder, however, it will be understood by those skilled in the art with benefit of this disclosure that other devices, including without limitation, springs and/or rotary actuators may be utilized. Biasing device 28 includes a regulator 36 which is in fluid communication with the control line 18. Regulator 36 can be utilized to set the load setting at which interlock device 16 responds to a load suspended from elevator 12. For example, when the load suspended from the assured elevator exceeds the load setting of biasing device 28, first member 24 and second member 26 can move relative to one another providing the stimulus for sensor 30 to lock the assured elevator in the closed position.

In the unloaded or unlocked position, a load or weight is not suspended from the assured elevator 12 that exceeds the load setting of biasing device 28. Thus, interlock device 16 and/or the assured elevator may be referred to as being in the unlocked position.

Figure 3:
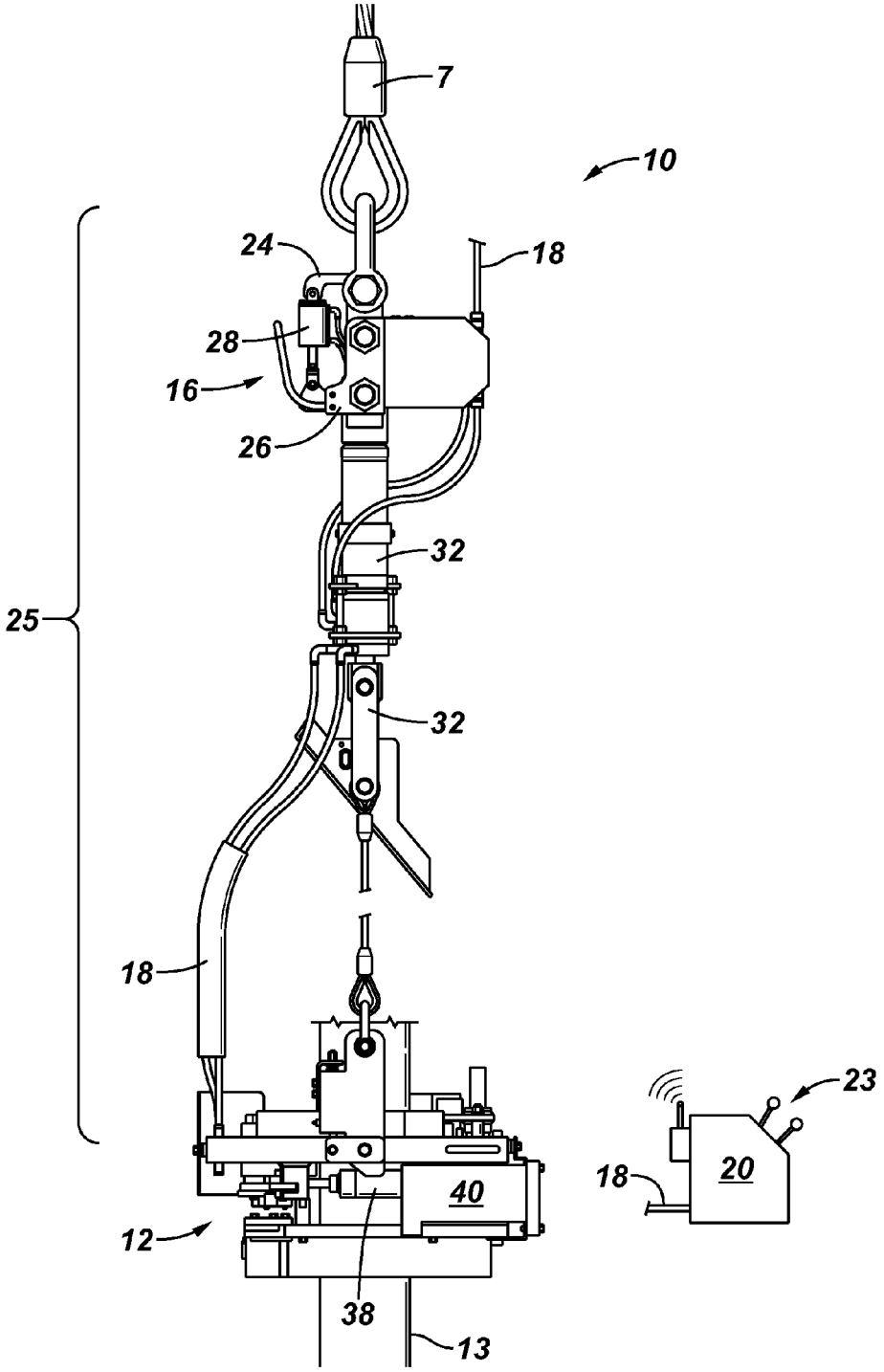
FIG. 3 is an elevation view of the grip assurance system of FIG. 2 illustrating the interlock device in a loaded position and the assured elevator in the locked closed position.
Figure 3A:
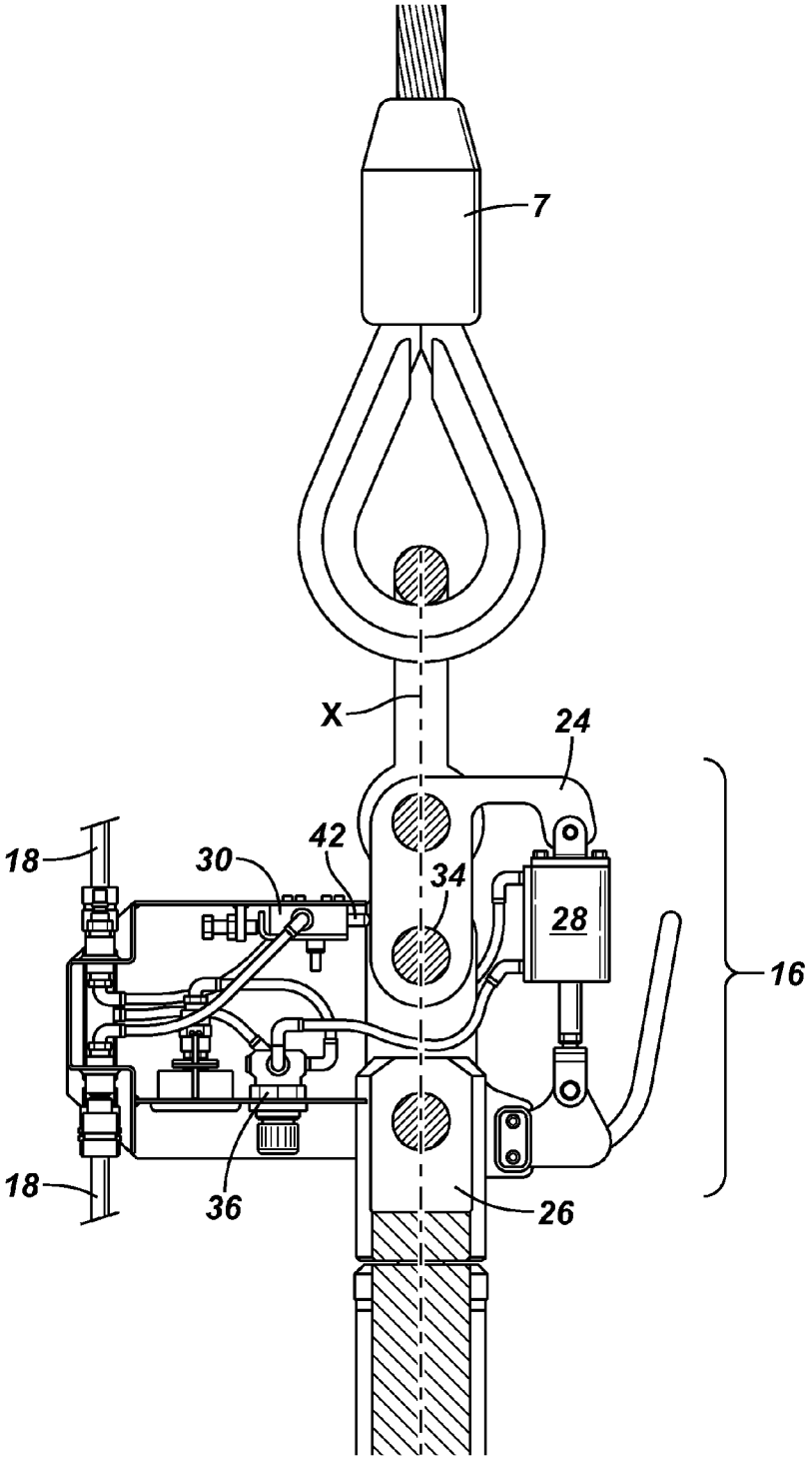

FIG. 3 is an elevation view of the elevator grip assurance system 10 depicting interlock device 16 in the loaded position (e.g., locked position), locking the assured elevator 12 in the closed position. FIG. 3A is an expanded, sectional view of interlock device 16 of FIG. 3 in the loaded position. Add-on tubular 13 is shown suspended from elevator 12 which is in the closed position. For example, in the depicted embodiment, fluidic power is transmitted to actuator 38 (e.g., cylinder) through control line 18 to power member(s) 40 (e.g., jaws, slips, doors and/or other actuated member(s)) to the closed position. In the closed position, elevator 12 supports the weight of add-on tubular 13.

In the loaded position, the weight suspended from elevator 12 (e.g., add-on tubular 13) exceeds the load setting of biasing or compensation device 28 allowing first member 24 and second member 26 to move relative to one another to the loaded position as shown in FIGS. 3, 3A. Sensor 30 (e.g., mechanical switch, proximity switch, pressure transducer, valve, optical sensors, magnetic sensors, etc.) detects the suspended load, in excess of the load setting interlock device 16, and blocks operational communication to elevator 12 thereby preventing actuation of elevator 12 to the open position and releasing support of add-on tubular 13. In the depicted embodiment, sensor 30 is a valve (e.g., solenoid) that is actuated upon contact of one of the first or the second members 24, 26 against the valve's actuator 42 (e.g., button, plunger) blocking communication of operational power (e.g., pneumatic, hydraulic, electricity) through control line 18 and across interlock device 16 to elevator 12. It will be understood by those skilled in the art with benefit of this disclosure, in particular with reference to the additional figures, that sensor 30 may communicate a wireless signal, for example to controller 20, associated with the load suspended from elevator 12.

When the load suspended from elevator 12 is reduced below the load setting of the compensation device, biasing device 28 and regulator 36, then biasing device 28 actuates first and second members 24 and 26 to move relative to one another to the unloaded position wherein sensor 30 actuates to permit operational communication to elevator 12 across interlock device 16. As will be understood by those skilled in the art with benefit of the disclosure, the load suspended from elevator 12 will be reduced, for example, upon connection to tubular string 5 (FIG. 1) and transfer of the weight of add-on tubular 13 and tubular string 5 to spider 17 (FIG. 1). In some embodiments, the load suspended from elevator 12 may be reduced upon transfer of support of add-on tubular 12 to another elevator, for example a string elevator, or tubular running device.

In the embodiment depicted in FIGS. 2, 2A, 3, and 3A, interlock device 16 can also provide a visual indication, for personnel on the rig, that a load is suspended from elevator 12 and that the weight has not been transferred to another tubular support device. The visual indicator can serve as an additional and/or backup safety measure. For example, in the unloaded position depicted in FIGS. 2 and 2A, the first member 24 and the second member 26 are angular offset from one another, such that they are not aligned parallel to one another along the vertical axis X (e.g., the gravitational axis). In the loaded position depicted in FIGS. 3, 3A, the first member 24 and the second member 26 are aligned within one another along, and parallel to, the vertical axis X.

Figure 4:
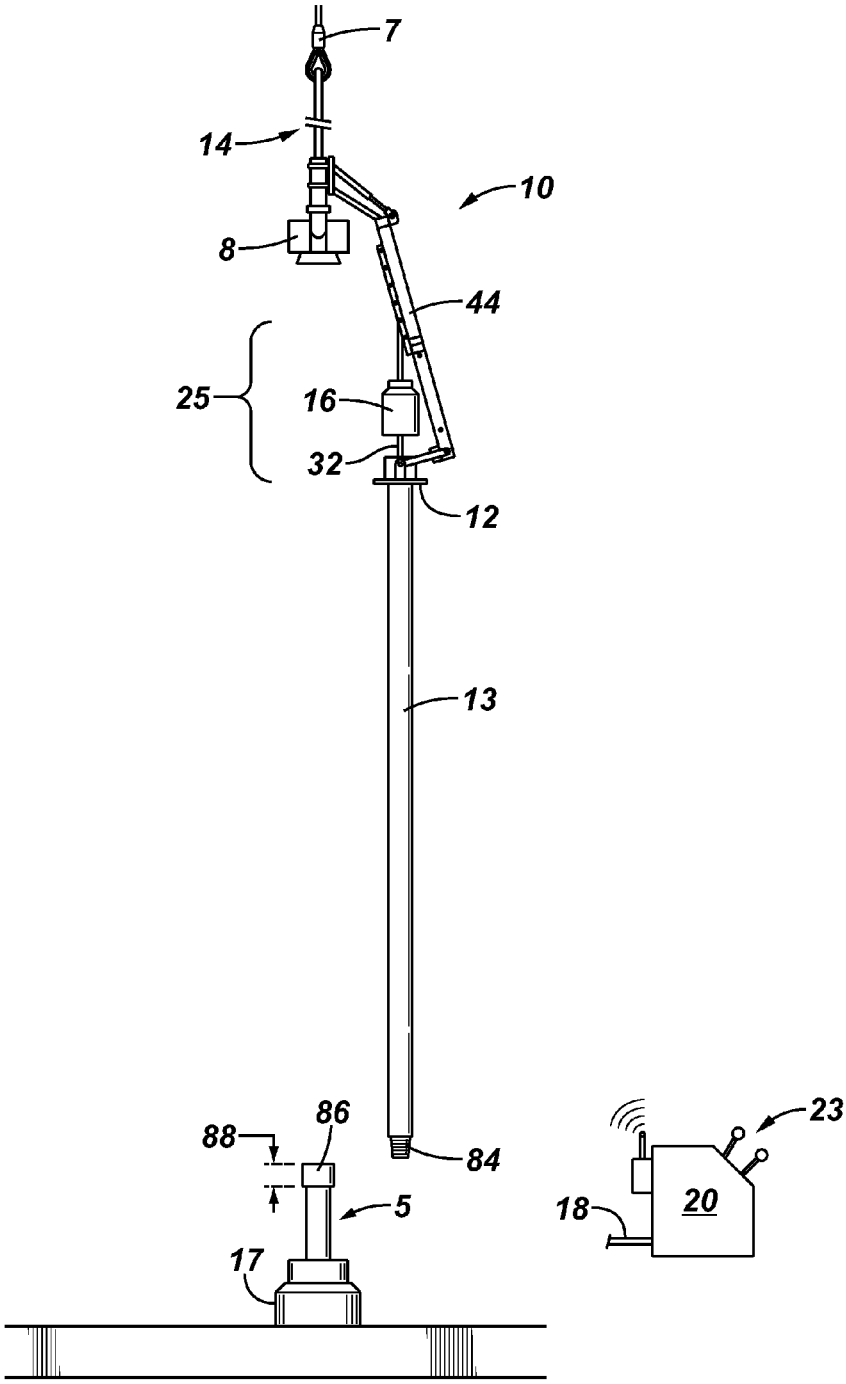
FIG. 4 is a schematic illustration of an elevator grip assurance system 10 utilized in another embodiment of a tubular running system.

FIG. 4 is a schematic illustration of an elevator grip assurance system 10 utilized in another embodiment of a tubular running system. This example depicts interlock device 16 connected within the load path 25 of an elevator 12 (e.g., single joint pick-up elevator) that is supported by a manipulator arm 44. Manipulator arm 44 can be actuated to move add-on tubular 13, for example, between a staging area and a position vertically aligned with tubular string 5. Elevator 12 may be raised and lowered (e.g., vertically moved) via the connection to hoisting device 7 through bails 14 in this example. An example of a pipe manipulator arm 44 is disclosed in U.S. 2008/0060818, which is incorporated herein by reference. This example further discloses an elevator 8 (e.g., string elevator) suspended from bails 14.

Figure 5:
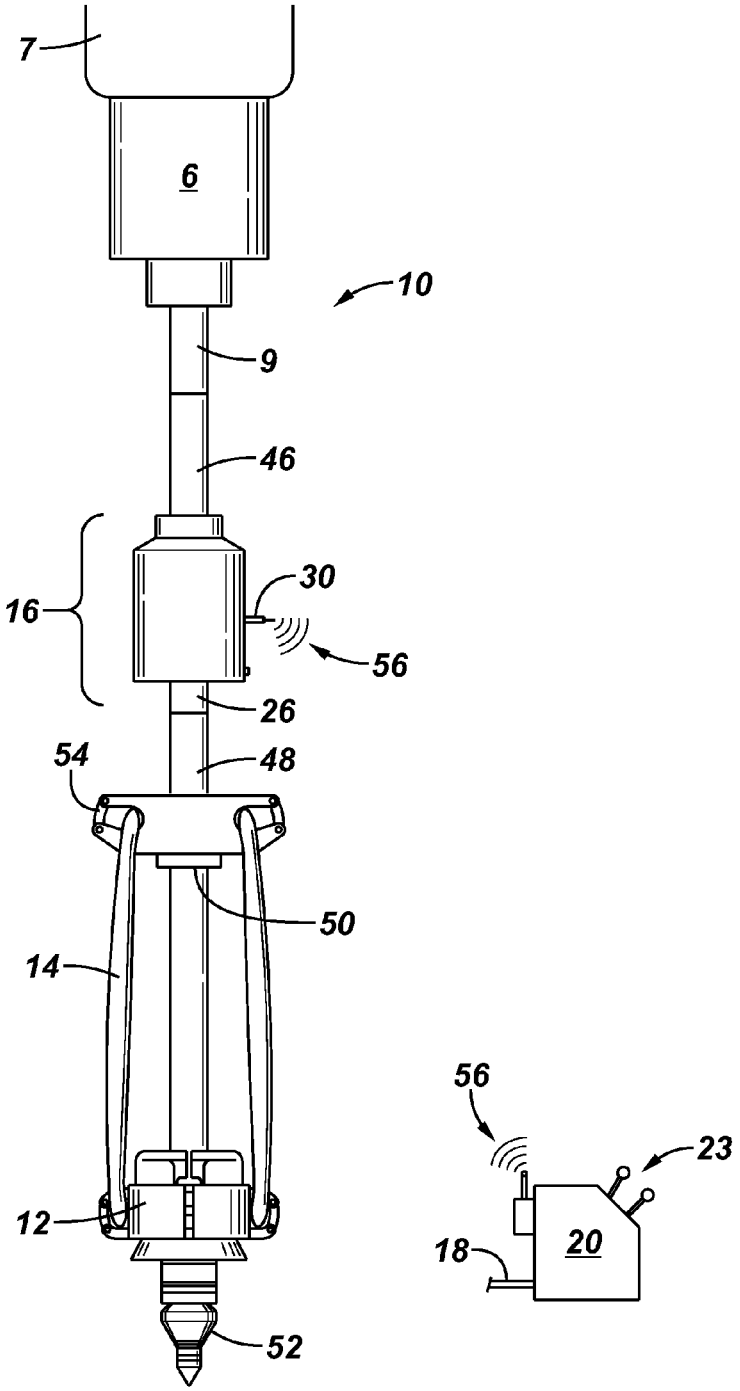
FIG. 5 is an elevation view of an embodiment of an interlock device according to one or more aspects of the invention operationally connected in the load path between a top drive and a conventional elevator.

FIG. 5 is an elevation view of another embodiment of an elevator grip assurance system 10 and interlock device 16. FIG. 5 depicts interlock device 16 connected within a load path 25 of an elevator 12. In the depicted embodiment, interlock device 16 (see FIGS. 7A, 7B) is connected to quill 9, for example via a sub saver 46, of top drive 6 (e.g., hoisting device). A sub 48 with a shoulder 50 is connected below interlock device 16. In this embodiment, a mud tool 52 (e.g., fill-up tool) is connected at the bottom end of sub 48. Elevator 12 is suspended by bails 14 from a hanger 54 that is attached to sub 48 at shoulder 50. In this example, hanger 54 is a shoulder type elevator that is installed upside down. In this embodiment, interlock device 16 is adapted to sense a load, above a load setting, that is suspended from elevator 12 and to send a wireless signal 56, for example, to controller 20 that can actuate an interlock (e.g., electronic and/or mechanical) that will prevent operating elevator 12 to the open position until the load suspended from elevator 12 is reduced below a load setting. As will be understood by those skilled in the art with benefit of the present disclosure, the load setting can be adjusted to compensate for the weight of equipment suspended below interlock device 16, including the grip assured elevator.

Figure 6:
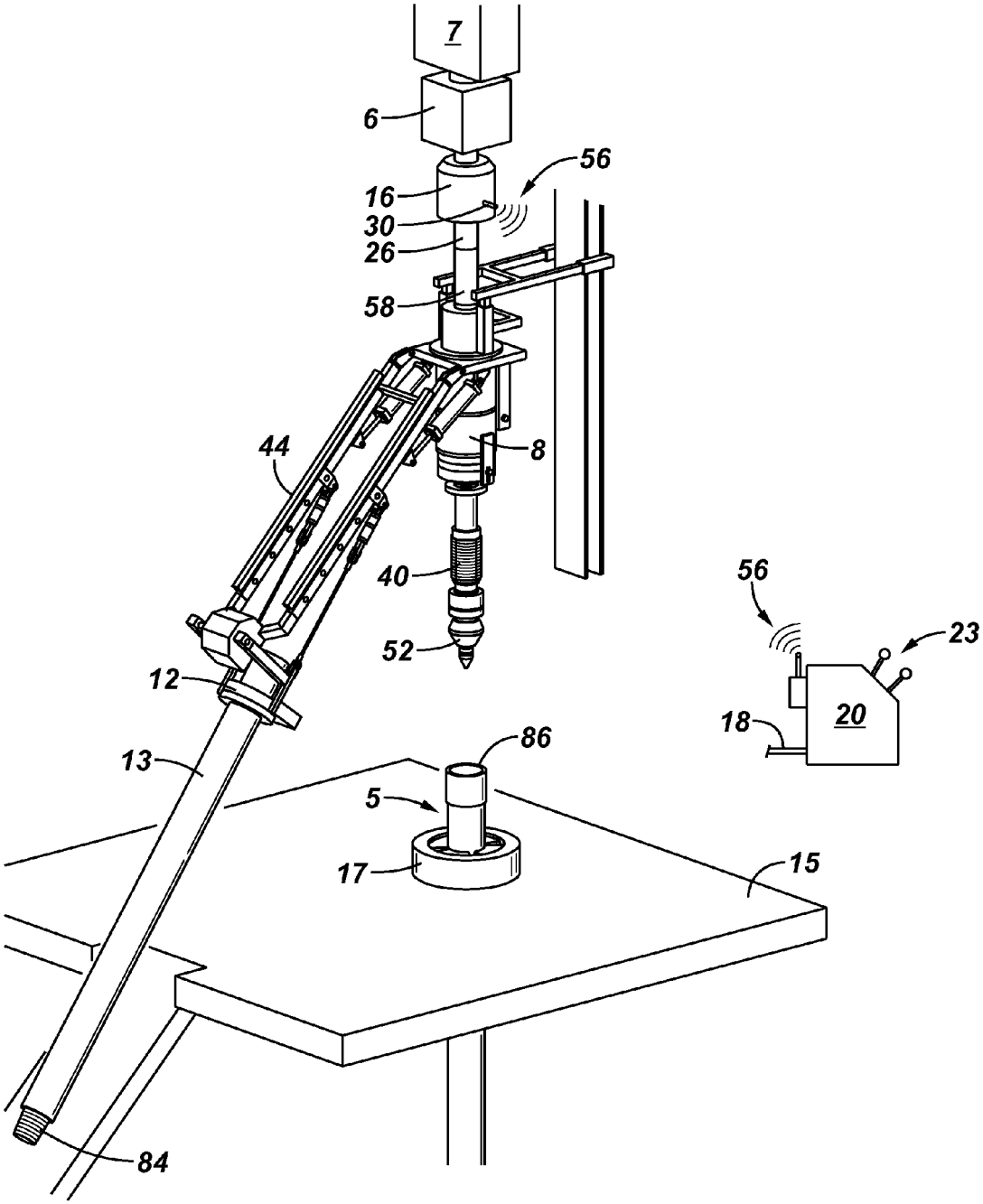
FIG. 6 is an embodiment of an interlock device according to one or more aspects of the invention operationally connected in the load path between a top drive and a tubular running tool type of elevator.

FIG. 6 is an elevation view of an embodiment of grip assurance system 10 utilized with a tubular running tool 8 (e.g., elevator). One example of a tubular running tool 8 is disclosed in US 2009/0314496, which is incorporated herein by reference. Tubular running tool 8 includes a mandrel 58 operationally disposed with power members 40, e.g., gripping members, to selectively grip, and support, a tubular (e.g., add-on tubular 13 and/or tubular string 5). In this embodiment mandrel 58 is operationally connected to hoisting device 7, providing vertical movement, and to top drive 6 to transfer torque and/or rotation to add-on tubular 13 to threadedly connect add-on tubular 13 to tubular string 5, to disconnect add-on tubular 13 from tubular string 5, and/or to apply rotation and torque to tubular string 5 for drilling related activities.

FIG. 6 depicts an elevator 12 (e.g., single joint pick-up elevator) suspended from manipulator arm 44. Elevator 12 is depicted supporting an add-on tubular 13 that is being moved, via manipulator arm 44, from a staging area to a vertical orientation proximate to the center of the rig floor 15, wherein casing running tool 8 can be actuated to position power members 40 into add-on tubular 13 and then actuated to the closed position by radially extending power members 40 into engagement with add-on tubular 13. Sensor 30 can then detect the additional load of add-on tubular 13 suspended from casing running tool 8 and in response actuate blocking of operational communication to operate tubular running tool 8, in particular power members 40, to the open position.

Figure 7B:
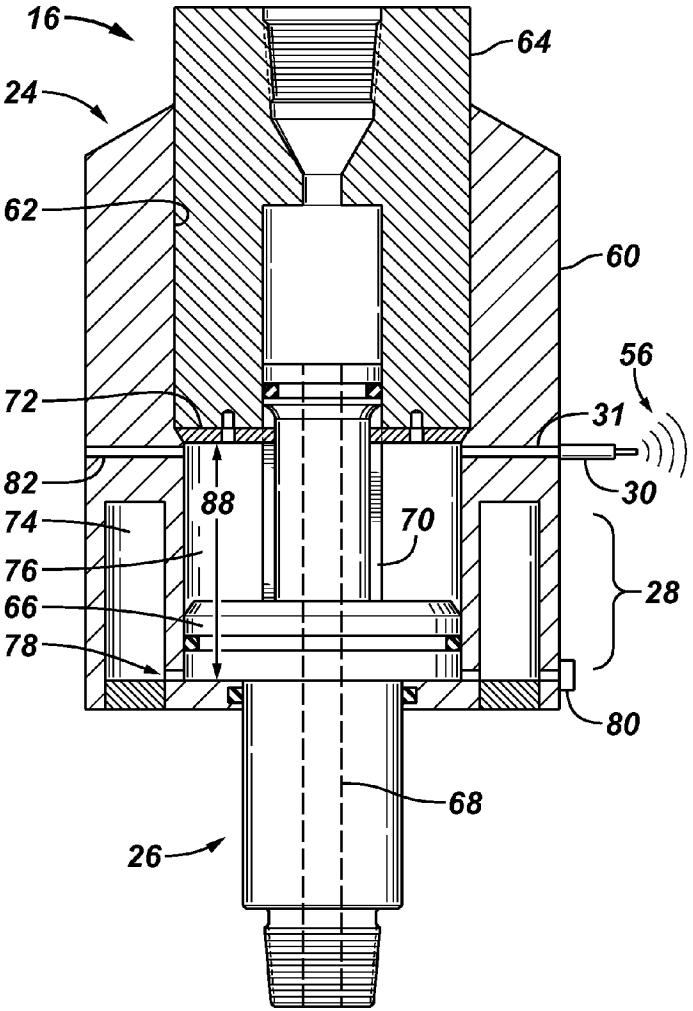
FIGS. 7A, 7B are sectional views of an embodiment of the interlock device according to one or more aspects of the invention described with reference to FIGS. 5 and 6.
Figure 7A:
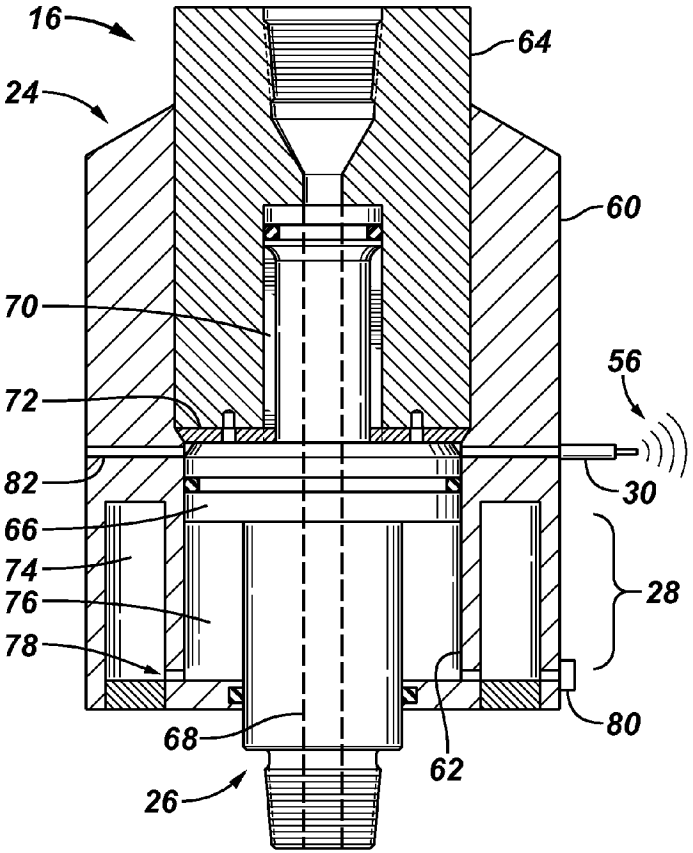

FIGS. 7A and 7B are sectional views of an embodiment of interlock device 16 as described with reference to FIGS. 5 and 6. FIG. 7A illustrates interlock device 16 in the unloaded position, associated with the grip assured elevator being in the open position, and FIG. 7B illustrates interlock device 16 in a loaded position, associated with the grip assured elevator being in the locked closed position. Depicted interlock device 16 comprises a first member 24 that is moveably connected with a second member 26. In this embodiment, first member 24 comprises an outer barrel 60 forming a throughbore 62 in which a portion of the second member 26, depicted as a piston in this embodiment, is disposed and in which a gland 64 is disposed and connected (e.g., by threading). Second member 26 includes a piston head 66 disposed in throughbore 62 and moveable therein (e.g., first member 24 and second member 26 are longitudinally moveable relative to one another). A fluid (e.g., drilling fluid, cement) passage 68 is formed through interlock device 16, extending in this embodiment through gland 64, second member 26 and a spline 70. Spline 70 is connected to piston head 66 and extends through a spline adapter plate 72 rotationally locking first member 24 and second member 26 together to transfer rotation and torque from top drive 6 (FIGS. 5, 6) through gland 64 of first member 24 to second member 26 (e.g., piston) and, for example, to the power members 40 (e.g., gripping members) of tubular running tool 8 depicted in FIG. 6.

Interlock device 16 comprises a biasing device 28 to compensate, e.g., to neutralize, a selected weight that is suspended in the load path below interlock device 16. In the depicted embodiment, biasing device 28 comprises a fluidicly pressurized (e.g., pneumatic, hydraulic) chamber 74 formed by first member 24 (e.g., outer barrel 60) that is in fluid communication with piston cylinder 76 portion of throughbore 62 through a conduit 78. A port 80 is depicted formed through the outer wall of first member 24 to connect a fluidic power source to pressurize chamber 74 and to set the load setting of interlock device 16 to neutralize a selected suspended weight. Chamber 74 of biasing device 28 may be pressurized and port 80 closed; or a fluidic power source, for example control line 18 (FIGS. 1, 5, 6), may remain connected to chamber 74, for example through a fluid swivel, allowing for adjustment of the load setting during tubular running operations.

A vent 82 is provided through first member 24 and in fluid communication with the piston cylinder 76 above piston head 66 relative to the side of piston cylinder 76 that is pressurized through chamber 74. Vent 82 is provided in this embodiment to prevent a vacuum from forming as piston head 66 moves downward in response to a load acting on second member 26 in excess of the load setting of biasing device 28. As will be understood by those skilled in the art with benefit of this disclosure, the load acting on second member 26 can include the weight of the equipment as well as a force created as add-on tubular 13 is threadedly connected to tubular string 5. For example, with reference in particular to FIGS. 1, 4, and 6, add-on tubular 13 has a threaded pin end 84 for threadedly connecting to the threaded box end 86 of tubular string 5. As add-on tubular 13 is threadedly connected to tubular string 5, it advances downward toward tubular string 5 and urges the connected second member 26 downward.

According to one or more aspects of the invention, interlock device 16 can provide for thread compensation. For example, with reference to FIGS. 7A, 7B, cylinder portion 76 can have a length 88 that permits piston head 66 to move in response to the suspended load added over the load setting, and thereby actuating the interlock, and to permit movement of piston head 66 a distance associated with the threading distance 88 of the pin 84 to box 86 connection. For example, FIG. 7B depicts piston head 66 proximate the bottom end of piston cylinder 76 representing the position associated with completion of a threaded connection.

A sensor 30 (e.g., mechanical switch, proximity switch, pressure transducer, valve, optical sensors, magnetic sensors, etc.) is operationally connected to second member 26 to detect a load suspended from second member 26 in excess of the load setting of biasing device 28. In this example, sensor 30 is in communication with piston cylinder 76 through a port 31 to detect the position of second member 26 via the position of piston head 66. In this embodiment, when sensor 30 detects the presence of piston head 66 in the unloaded position (FIG. 7A) then actuation of the assured elevator (e.g., tubular running tool 8 of FIG. 6) is permitted. In this embodiment, when a load above the load setting of biasing device 28 is suspended from second member 26, piston head 66 moves out of the unloaded position of FIG. 7A and sensor 30 responds by blocking operational communications to the assured elevator, thereby prevention actuation of the assured elevator to the open position.

A method according to one or more aspects of the invention is described with reference to all of the figures. The method includes suspending a tubular from an elevator, wherein the elevator is in a closed position supporting the tubular; detecting a load suspended from the elevator; and locking the elevator in the closed position in response to the detected load. The elevator may be unlocked and permitted to be operated to an open position in response to detecting the removal of the suspended load.

The elevator grip assurance system 10 includes interlock device 16 connected in the load path 25 between a hoisting device and the elevator. In at least one embodiment, rotation is provided from a top drive to the elevator. The rotation is transmitted through the load path and the interlock device 16.

According to one or more aspects of the invention, detecting the weight suspended from the elevator includes detecting movement of the first member and the second member of the interlock device relative to one another. The movement of the first member and the second member relative to one another is responsive to the suspended weight being greater than a load setting of the interlock device. The elevator may be locked in the closed position by blocking operational communication to the elevator.

The method can include threadedly connecting the tubular suspended by the elevator to a tubular string and permitting movement of the first member and the second member relative to one another a distance associated with the threading distance the suspended tubular to the tubular string. The threaded connection may be provided by transmitting rotation from a top drive to the suspended tubular through the interlock device. Accordingly, the first and second members may be rotationally locked together and longitudinally moveable relative to one another.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An interlock device for connection within a vertical load path between a hoisting device and a tubular support device, the device comprising:

a first member moveably connected to a second member, the first member to be connected to the hoisting device and the tubular support device to be suspended from the second member;

a biasing mechanism operationally connected to the first member and the second member providing a load setting resisting movement of the first member and the second member relative to one another; and a sensor to detect movement of the first member and the second member relative to one another, wherein the sensor is operationally connectable to the tubular support device to lock the tubular support device in a closed position in response to detecting the movement of the first member and the second member relative to one another.

2. The device of claim 1, wherein the first member and the second member are moveably connected through a pivot point.

3. The device of claim 1, comprising a valve to pass a power supply to the tubular support, wherein the valve closes in response to movement of the first member and the second member relative to one another.

4. The device of claim 1, wherein the second member comprises a piston having a piston head moveably disposed within a cylinder portion of the first member.

5. The device of claim 1, wherein the first member and the second member are rotationally locked to one another and longitudinally moveable relative to one another.

6. An elevator grip assurance system, the system comprising:

an interlock device connected in the vertical load path between a hoisting device and an elevator, the interlock device comprising a load setting urging a first member and a second member into an unloaded position relative to one another, wherein the first member is in connection with the hoisting device and the elevator is suspended from the second member; and a sensor to lock the elevator in a closed position in response to a weight suspended from the elevator.

7. The system of claim 6, wherein the suspended weight exceeds the load setting.

8. The system of claim 6, wherein the first member and the second member move relative to one another in response to the weight suspended from the elevator.

9. The system of claim 6, wherein the load path extends from the hoisting device to the elevator.

10. The system of claim 9, wherein the first member and the second member rotate in unison thereby transmitting rotation from the top drive to the elevator.

11. The system of claim 6, wherein the first member and the second member are angularly aligned with one another along the vertical load path when the weight is detected suspended from the elevator and the first member and the second member are angularly offset from one another along the vertical load path when a weight is not detected.

12. A method comprising:

suspending a tubular from an elevator, wherein the elevator is in a closed position supporting the tubular;

detecting a load suspended from the elevator in response to detecting movement of a first member and a second member of an interlock device relative to one another, wherein the interlock device is connected in a vertical load path between a hoisting device in connection with the first member and the elevator suspended from the second member; and locking the elevator in the closed position in response to the detected load.

13. The method of claim 12, further comprising permitting the elevator to be operated to an open position in response to detecting the release of the suspended load.

14. The method of claim 12, further comprising transmitting rotation from a top drive through the interlock device to the elevator.

15. The method of claim 12, wherein the locking the elevator in the closed position comprises blocking operational communication to the elevator.

16. The method of claim 12, wherein the interlock device comprises:

a biasing mechanism providing a load setting urging the first member and the second member to an unloaded position relative to one another; and a sensor positioned to detect movement of the first member and the second member from the unloaded position.

17. The method of claim 16, further comprising:

threadedly connecting the tubular suspended by the elevator to a tubular string; and permitting movement of the first member and the second member relative to one another a distance associated with the threading distance the suspended tubular to the tubular string.

18. The method of claim 17, wherein the threadedly connecting comprises transmitting rotation from a top drive to the suspended tubular through the interlock device.

19. The method of claim 16, wherein the interlock device comprises a spline rotationally locking the first member and the second member together.

20. The method of claim 12, wherein the first member and the second member are angularly aligned with one another along the vertical load path when the load is detected suspended from the elevator and the first member and the second member are angularly offset from one another along the vertical load path when a load is not detected.

* * * * *